United States Patent [19]

Johnson et al.

[11] Patent Number: 4,589,503

[45] Date of Patent: May 20, 1986

[54] TOP DRIVE DRILLING APPARATUS WITH IMPROVED WRENCH ASSEMBLY

[75] Inventors: Horace A. Johnson, Houston; Roger Smith, Jr., Georgetown, both of Tex.

[73] Assignee: Hughes Tool Company, Houston, Tex.

[21] Appl. No.: 788,668

[22] Filed: Oct. 17, 1985

Related U.S. Application Data

[63] Continuation of Ser. No. 600,939, Apr. 16, 1984, abandoned.

[51] Int. Cl.[4] ..... E21B 19/06

[52] U.S. Cl. ..... 175/113; 173/44; 81/57.31; 81/57.35; 175/85

[58] Field of Search ..... 175/32, 85, 113; 166/77.5, 85; 173/42, 43, 44, 164; 81/57.33, 57.34, 57.35

[56] References Cited

U.S. PATENT DOCUMENTS

| | | | |
|---|---|---|---|
| 3,527,309 | 9/1970 | Rassieur | 173/28 |
| 3,799,009 | 3/1974 | Guier | 81/57.34 |
| 3,808,916 | 5/1974 | Porter | 81/57.19 |
| 3,832,918 | 9/1974 | Lang et al. | 81/57.34 |
| 4,023,449 | 5/1977 | Boyadjieff | 81/57.35 |
| 4,147,215 | 4/1979 | Hodge et al. | 166/77.5 |
| 4,194,419 | 3/1980 | Mitchhart et al. | 81/57.35 |
| 4,345,493 | 8/1982 | Rassieur | 81/57.34 |
| 4,421,179 | 12/1983 | Boyadjieff | 173/44 |
| 4,440,536 | 4/1984 | Scaggs | 175/85 |
| 4,449,596 | 5/1984 | Boyadjieff | 175/85 |

FOREIGN PATENT DOCUMENTS

| | | |
|---|---|---|
| 1603776 | 7/1971 | France . |
| 2531479 | 2/1984 | France . |

OTHER PUBLICATIONS

"Power Swivel, DDM-650, Derrick Drilling Machine," Maritime Hydraulics.

"Varco Top Drive Drilling System, Description and Specifications," Varco Oil Tools, Feb. 1983.

*Primary Examiner*—Stephen J. Novosad
*Assistant Examiner*—William P. Neuder
*Attorney, Agent, or Firm*—H. Dennis Kelly

[57] ABSTRACT

A top drive well drilling apparatus, having a drive unit for rotating a drill string. The drive unit is connected to a carriage, which guides the drive unit along a vertical guide track. A wrench assembly, for making and breaking connections between the stem of the drive unit and the drill string, can be moved between a working position along the stem and a retracted position away from the stem. The wrench assembly can also be moved vertically, and is mounted on the carriage.

3 Claims, 3 Drawing Figures

55
23
53
51
49
49
43
47
29
45
33
37
35

TOP DRIVE DRILLING APPARATUS WITH IMPROVED WRENCH ASSEMBLY

This application is a continuation of application Ser. No. 06/600,939, filed Apr. 16, 1984, now abandoned.

BACKGROUND OF THE INVENTION

1. Field of the Invention

This invention relates in general to a well drilling apparatus and in particular to a top drive well drilling apparatus.

2. Description of the Prior Art

A top drive drilling system rotates a drill string from the top, rather than using a rotary table, a kelly, and a kelly bushing. An electric drilling motor is suspended from the drilling rig's conventional swivel and is attached to the top of the drill string. The drilling motor may also be attached to a carriage, which is guided by a pair of vertical tracks. The drilling motor is connected to the drill string by a cylindrical stem, which extends downward from the motor. A wrench assembly is also suspended from the drilling motor, in order to break out or make up connections between the stem and the drill string. A drill pipe elevator is suspended by links below the bottom of the stem. As the drill string is drilled down, the elevator will contact the floor of the drilling rig. If the elevator and the wrench assembly could be moved out of the way, the drill string could be drilled down further before additional lengths of pipe must be added to the drill string.

SUMMARY OF THE INVENTION

The present invention is a top drive well drilling apparatus in which the wrench assembly is mounted on a carriage and can be retracted away from the stem and the drill string. The wrench assembly can be moved between a working position over well center and a retracted position away from well center. The wrench assembly can also move vertically.

The above, as well as additional objects, features, and advantages of the invention, will become apparent in the following detailed description.

DESCRIPTION OF THE PREFERRED EMBODIMENT

Figure 1:
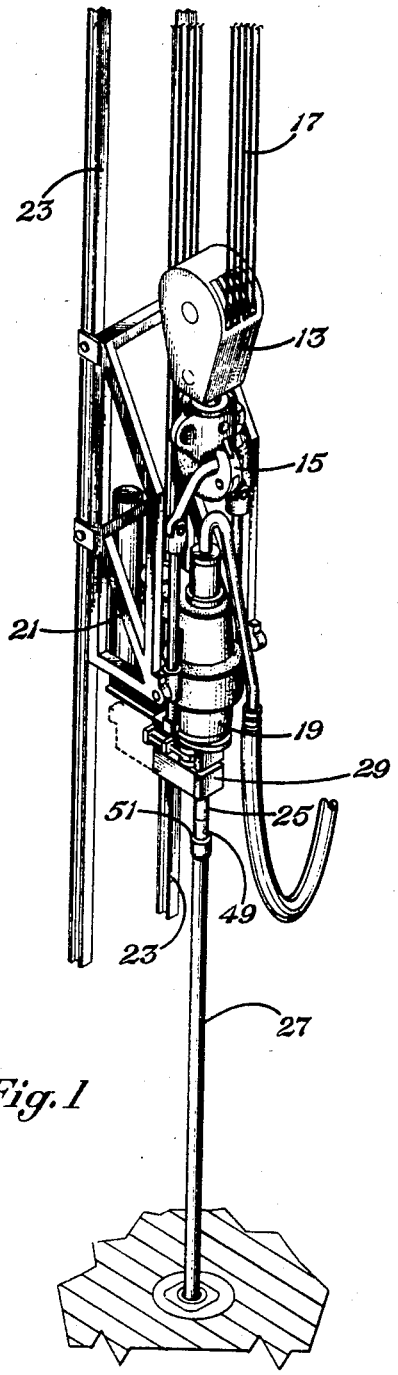
FIG. 1 is a perspective view of a drilling apparatus of the invention.

FIG. 1 illustrates a top drive well drilling apparatus of the invention. A conventional traveling block 13 and a conventional hook 15 are suspended by cables 17 from the top of an oil well derrick. A drive unit 19 is suspended from the hook 15 and mounted on a carriage 21. The drive unit 19 is a drilling motor of a conventional type. The carriage 21 guides the drive unit 19 up and down along a pair of vertical guide tracks 23. A cylindrical quill, or stem 25, extends downward from the drive unit 19, and connects to the top of a drill string 27. The drill string 27 consists of a series of pipe sections and has a rotary rock bit attached at the bottom for drilling a well bore.

A wrench assembly 29 is provided for making up the connection between the stem 25 and the drill string 27. The wrench assembly is mounted to the carriage 21, and is capable of moving between a working position along the stem 25, or the axis of the drill string 27, and a retracted position away from the stem 27. The wrench assembly 29 is also capable of moving vertically along the stem 25 and the drill string 27.

Figure 2:
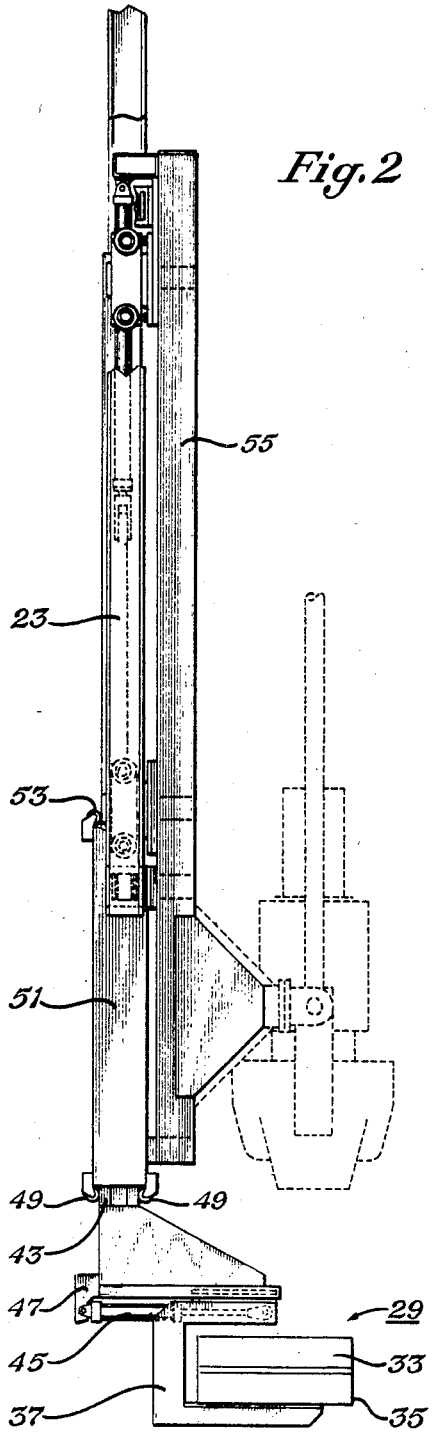
FIG. 2 is a side view of a carriage and a wrench assembly.
Figure 3:
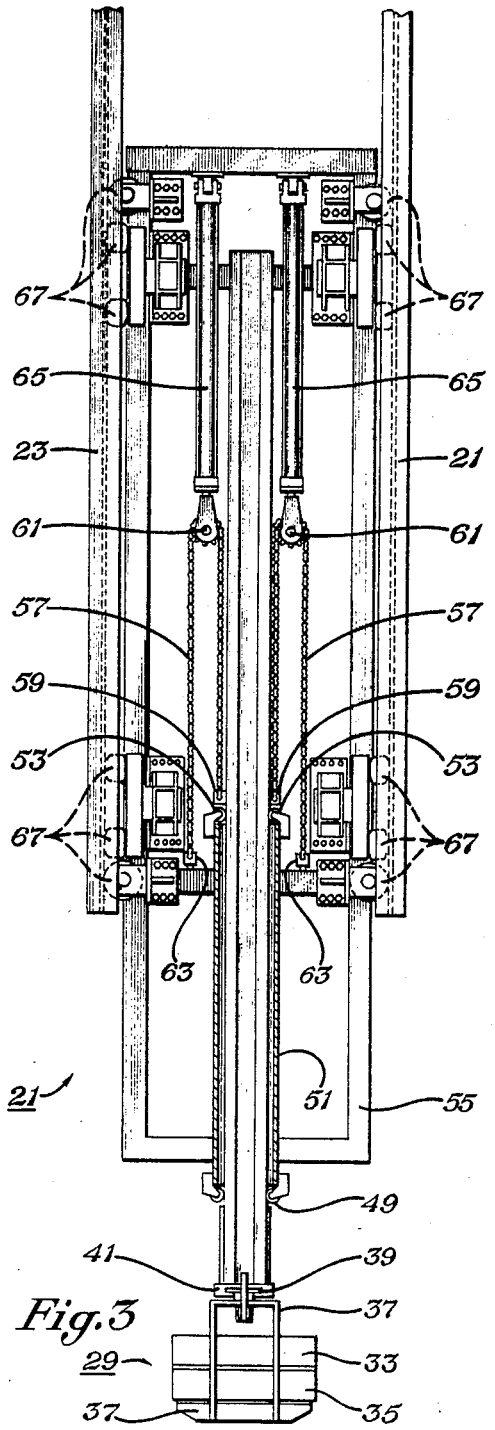
FIG. 3 is a front view of a carriage and a wrench assembly.

FIGS. 2 and 3 are close-up views of the carriage 21 and the wrench assembly 29. The wrench assembly 29 has a top wrench 33 and a bottom wrench 35. These wrenches 33, 35 may be openfaced, but preferably have a load-bearing gate. The top wrench 33 is a spline wrench and is adapted to engage the stem 25. The bottom wrench 35 has grippers and is adapted to engage the drill string 27. The wrenches 33, 35 can thus be used to make up or break out connections between the stem 25 and the drill string 27 in a manner well known in the art. The wrench assembly 29 can also be used to make up or break out connections between various subs between the stem 25 and the drill string 27, such as kelly cocks.

The wrench assembly 29 is carried by a C-shaped bracket 37. This bracket 37 has a T-shaped flange 39, which fits within a slot 41 on the bottom of a vertically movable inner tube 43. The bracket 37 is also connected to a hydraulic cylinder 45, which is secured to a flange 47 extending down from the inner tube 43.

The inner tube 43 passes upward between a set of rollers 49 into an outer tube 51. The inner tube 43 continues upward, out of the outer tube 51, and between a second set of rollers 53. The outer tube 51 is welded to the frame 55 of the carriage 21, and the inner tube 43 is movable vertically through the outer tube 51.

A pair of chains 57 are attached to brackets 59 on each side of the inner tube 43. Each chain 57 extends upward, around a pulley 61, and then downward to a bracket 63 on the carriage 21. The bracket 37, the inner tube 43, and the chains 57 are thus a means for mounting the wrench assembly 29 on the carriage 21. The pulleys 61 are each mounted on the lower ends of hydraulic cylinders 65, the upper ends of which are connected to the carriage 21. The carriage 21 has a plurality of wheels 67, which guide the carriage 21 along the guide tracks 23.

In operation, the hydraulic cylinder 45 connected to the wrench assembly bracket 37 is a means for moving the wrench assembly 29 between a working position along the axis of the drill string 27 and a retracted position away from the stem 27. FIG. 2 illustrates the wrench assembly 29 in the working position, with the hydraulic cylinder 45 fully extended. As the cylinder 45 is retracted, the bracket 37 and the wrench assembly 29 are moved to the retracted position. When the cylinder 29 is extended, the bracket 37 and wrench assembly 29 are returned to the working position.

The hydraulic cylinders 65 attached to the carriage 21 are a means for moving the wrench assembly 29 vertically, relative to the stem 25. FIGS. 2 and 3 illustrate the wrench assembly 29 in the uppermost position relative to the stem 25, and the cylinders 75 are fully retracted. To lower the wrench assembly 29, the cylinders 65 are extended. The chains 55 and pulleys 61 create a two to one ratio between the movement of the wrench assembly 29 and the movement of the pulleys 61. For example, if the cylinders 65 are extended to move the pulleys 61 downwards four feet, the wrench assembly 29 will be moved downward a distance of eight feet.

The well drilling apparatus of the invention has an improved wrench assembly 29, which provides several advantages over the prior art. The capability of moving vertically enables the wrench assembly 29 to break connections at several points along the stem 25 and drill string 27, and the break out can be performed anywhere in the derrick. The retractability of the wrench assembly 29 enables the wrenches 33, 35 to get around obstacles along the axis of the stem 25, such as kelly cocks.

While the invention has been shown in only one of its forms, it should be apparent to those skilled in the art that it is not so limited, but is susceptible to various changes and modifications, without departing from the spirit thereof.

We claim:

1. A top drive well drilling apparatus, comprising:

a drive unit for rotating a drill string about the longitudinal axis of the drill string;

a guide track, which extends generally in a vertical direction;

a carriage for connecting and guiding the drive unit along the guide track;

a stem, extending downward from the drive unit, for transmitting torque from the drive unit to the drill string;

a wrench assembly for making and breaking connections between the stem and the drilling string; and means for moving the wrench assembly between a working position along the stem and a retracted position away from the stem.

2. A top drive well drilling apparatus, comprising:

a drive unit for rotating a drill string about the longitudinal axis of the drill string;

a guide track, which extends generally in a vertical direction;

a carriage for connecting and guiding the drive unit along the guide track;

a stem, extending downward from the drive unit, for transmitting torque from the drive unit to the drill string;

a wrench assembly for making and breaking connections between the stem and the drilling string;

means for moving the wrench assembly between a working position along the stem and a retracted position away from the stem; and means for moving the wrench assembly vertically in relation to the stem.

3. A top drive well drilling apparatus, comprising:

a drive unit for rotating a drill string about the longitudinal axis of the drill string;

a guide track, which extends generally in a vertical direction;

a carriage for connecting and guiding the drive unit along the guide track;

a stem, extending downward from the drive unit, for transmitting torque from the drive unit to the drill string;

a wrench assembly for making and breaking connections between the stem and the drilling string;

means for moving the wrench assembly between a working position along the stem and a retracted position away from the stem;

means for moving the wrench assembly vertically; and means for mounting the wrench assembly on the carriage.

* * * * *